US008282586B2

(12) United States Patent
Mira Rodriguez

(10) Patent No.: US 8,282,586 B2
(45) Date of Patent: Oct. 9, 2012

(54) DEVICE FOR PREVENTING SKIN SAG AND WRINKLES

(76) Inventor: Encarnacion Mira Rodriguez, Madrid (ES)

( * ) Notice: Subject to any disclaimer, the term of this patent is extended or adjusted under 35 U.S.C. 154(b) by 274 days.

(21) Appl. No.: 12/865,963

(22) PCT Filed: Mar. 25, 2009

(86) PCT No.: PCT/ES2009/000163

§ 371 (c)(1),
(2), (4) Date: Aug. 3, 2010

(87) PCT Pub. No.: WO2010/007184

PCT Pub. Date: Jan. 21, 2010

(65) Prior Publication Data

US 2011/0004130 A1 Jan. 6, 2011

(30) Foreign Application Priority Data

Jul. 17, 2008 (ES) ..... 200802131

(51) Int. Cl.
*A61H 7/00* (2006.01)

(52) U.S. Cl. ..... 601/137

(58) Field of Classification Search ..... 601/46, 601/80, 84, 85, 137; 84/457
See application file for complete search history.

(56) References Cited

U.S. PATENT DOCUMENTS

| | | | | |
|---|---|---|---|---|
| 329,090 | A * | 10/1885 | Segrove | 84/457 |
| 1,715,324 | A * | 5/1929 | Haglund | 84/457 |
| 2,529,430 | A * | 11/1950 | Stanton | 84/457 |
| 2,888,582 | A | 5/1959 | Hetzel | |
| 3,405,589 | A | 10/1968 | Myers | |
| 7,381,193 | B2 * | 6/2008 | Nogami | 601/46 |
| 2004/0143200 | A1 | 7/2004 | Nogami | |

FOREIGN PATENT DOCUMENTS

| | | |
|---|---|---|
| DE | 7405 | 3/1879 |
| DE | 197 17 053 A1 | 10/1998 |
| GB | 657413 | 9/1951 |

OTHER PUBLICATIONS

Written Opinion of the International Searching Authority issued May 14, 2009, in Application No. PCT/ES2009/000163 (with English translation).

International Search Report issued Jul. 17. 2009 in PCT/ES 2009/00163.

"La eterna juventud en clave de DO" (Retrieved on May 14, 2009 from Internet, URL:http://web.archive.org/web/20080129225024/http://www.vanitatis.com/cache/2007/11/28/73_eterna_juventud_clave.html.

* cited by examiner

*Primary Examiner* — Michael A. Brown
(74) *Attorney, Agent, or Firm* — Oblon, Spivak, McClelland, Maier & Neustadt, L.L.P.

(57) ABSTRACT

Device for preventing skin sag and wrinkles, formed by two main parts, i.e. a tuning fork and pyramid-shaped stone which are permanently joined together by means of cold-soldering. The device is configured so that the vertex of the pyramid is inserted inside the free end of the bored base of the tuning fork. The tuning fork may have two, three or four arms. For professional use it may have a cylinder at the end of each arm. Joining together of the two main parts may be performed by means of a hollow middle part which at one end is inserted inside the tuning fork and at the other end is joined to the pyramid. The device is used in the cosmetics sector in order to remedy skin sag, smooth skin wrinkles and rejuvenate and brighten up the face and other parts of the body.

13 Claims, 4 Drawing Sheets

DEVICE FOR PREVENTING SKIN SAG AND WRINKLES

FIELD OF THE INVENTION

This invention refers to a device formed by two permanently connected parts and their use in the field of cosmetics in order to prevent skin sag, and smooth out wrinkles in the skin, as well as rejuvenating and restoring luminosity to the face and other parts of the body.

BACKGROUND TO THE INVENTION

Apparatus used for facial cosmetic treatment are known in the art, for example, the device described in document ES 1023162 U which comprises a hollow treatment head filled with cold accumulation liquid and a handle with a retaining element which fits into said treatment head; or that described in document ES 1023163 U with a grip or handle which contains an electric activator for vibration or eccentric adjustment of a treatment head which can be eventually interchangeable and to which is associated a specially adjustable electrical heating device.

Document DE 7405 C1 refers to a musical tuning fork with two tines which may be fitted with an adjustable screw or screw adjustable clamp. Likewise, document U.S. Pat. No. 2,888,582 A refers to musical tuning forks having more than two tines, specifically three or four, some of which may be shorter in order to produce higher sound tone.

The U.S. Pat. No. 4,427,001 describes an apparatus for face treatments which includes a spoon shaped bowl for massaging against the face, which is connected to a transformer for heating up the bowl surface, wiring from the transformer to a control switch on the handle and to an electric power source, while a rear side of the device includes a reservoir for oil or cream from which the oil or cream can be dispensed as wished./, and a sponge on which the oil or cream is dispensed.

There are various documents (FR 1182894 and U.S. Pat. No. 4,550,718) which describe a facial massage device consisting of a support formed of a handle connected to a massage plate which houses one or various massage balls which rotate over the face, thus providing a massage.

The document U.S. Pat. No. 5,746,702 describes a method for providing a medicinal massage to the skin and an ergonomic apparatus which carries it out.

The U.S. Pat. No. 6,679,908 B2 describes a facial treatment using a device which can cool or heat up the face of the person receiving the treatment and when applied to the body it has a slimming effect on the treated part.

In document JP 2000000283 the skin of a person is massaged using a device which is able to vibrate, rotate or both actions simultaneously.

The document US 2008/0058915 A1 describes a membrane in the form of a face mask and its application in the field of cosmetics and health. It is related to "acupuncturer" or acupuncture points which through transcutaneous stimulation using electrical means, specifically with electrodes, stimulate the nerve or the muscle.

The document US2004143200 A1 describes a therapeutic tuning fork which is used for massage or acupressure with two tines joined to a handle or grip of the same material as the tuning fork however, it is covered with a material which makes it easy to grip, preferably rubber or wood at the end of which a part is joined which may vary so that it contacts with the patient, made from an appropriate material such as metal, plastic, rubber, wood or similar in nature and preferably covered in the contact zone with a piece of fabric. Said piece may be joined by a screw to the handle and thus can be easily dismounted.

The document DE 19717053 A1 refers to pyramids for medical use. The sides of said pyramids are of a specific size varying from 1 cm to 10 cm and they may be equal or different, and may have three-five points, being made from aluminium or an aluminium alloy. In order to be effective, several should be distributed over the body surface and they should be left for a specific period (see FIG. 2).

The article entitled *La eterna juventud en clave de Do* (Eternal youth in the key of C) dated 28.11.2007 from Vanitatis.com discloses the use of a tuning fork on facial skin in order to revitalize the skin's cellular activity, firming and toning the facial musculature, recovering elasticity and combating stress. However, there is no indication of the use of any part at the end of the fork, through which vibrations are transmitted to the skin.

OBJECT OF THE INVENTION

The device which is the object of this invention consists of a combination of two basic connected parts, namely a tuning fork and a stone pyramid, which when joined in a specific manner act together to produce a surprising effect when used as a cosmetic application on the skin.

A tuning fork is a part having a base and two tines in a U-shape, made from an elastic metal (generally steel). When it is tapped it vibrates generating an almost inaudible wave depending on the frequency (in order to hear it, it must be held close to the ear and should never be rested on the skull, or amplified it by resting it against a wooden resonance box such as the body of a stringed instrument, for example). The most commonly used tuning fork is the 440 (which means that it generates an $A_4$ note with precisely 440 Hz. Under water, a 440 Hz tuning fork has a frequency of around 650 Hz. Due to this feature, the tuning fork is used as a frequency standard for tuning musical instruments.

The tuning fork used for the device which is the object of the invention may be the classic two-tined fork however, it may have more tines, such as three or four.

Stone pyramids are crystalline forms which have a base and three, four, six, eight or twelve lateral faces which are not parallel and which converge in a common vertex.

Although the effect of the pyramid was known in Ancient Egypt, knowledge of pyramids was revived by a French scientist Antoine Bovis, who was able to reproduce mummification of animals. In general, it was found that all foods can be feasibly conserved under the pyramid due to the fact that the pyramid functions as a catalyst, condensing and focusing energetic vibration. From the nineteen seventies work began on the effect of pyramids on human health (Rev. Cubana Med. Gen. Integr. 2003; 19 (2)).

The device which is the object of this application consists of joining both parts in a specific manner so that the vibrations transferred by the tuning fork to the skin will be made through a stone pyramid, so that the tuning fork and the stone pyramid act together, complementing and producing surprising effects on the skin.

The use of a stone pyramid is fundamental for obtaining the surprising effect of preventing skin sag and muscular weakness, smoothing out skin wrinkles and, at the same time, oxygenating cells thus rejuvenating the skin and giving it a luminous aspect.

The use of any of the parts having various shapes used in the document US2004143200 do not produce beneficial results such as those obtained by use of a stone pyramid as a part for transferring vibration of the tuning fork.

DESCRIPTION OF THE INVENTION

The device for preventing skin sag and wrinkles which is the object of this invention comprises two fundamental parts comprising the metal tuning fork and the stone pyramid.

Another object of this invention is the arrangement of these two main parts of the device in order to obtain the desired effect, in such a way that the base of the tuning fork is arranged in contact with the upper part or vertex of the pyramid, and the base of the pyramid is applied on the skin to be treated.

Certain variants of the basic parts are also part of the invention as they enter the inventive step which improves the effect produced on the skin and which will be explained below.

The functioning of the device is based on tapping the tuning fork to produce a vibration which is transferred through the pyramid and reaches the skin.

The applicant has found that the vibration of the tuning fork which passes through the pyramid produces an effect on the state of the skin to be treated, improving blood circulation and therefore improving oxygenation of cells and also rehabilitating muscles, thus having the effect of passive gymnastics.

As a result it is possible to achieve a cosmetic treatment on the skin without using electrical current, or heat or cold, or vibrations generated by motors, or chemical compounds, thus preventing any secondary effects which these procedures can cause.

The device should not be applied when there is any skin infection present such as herpes, virus or bacteria, or dental problems, nor should it be used in cases of skin or jaw cancer. Conversely, it may be applied in cases of eczema or psoriasis, provided that there is no infection or suppuration.

Materials and Sizes

The device functions better if the tuning fork is made from steel or aluminium with alloys and when the pyramid is made from any precious or semi-precious stone.

A preferred embodiment of the pyramid is made in black stone such as black tourmaline or onyx.

The size of the device may vary, the so called standard size is for domestic use or it may be larger if the device is to be used professionally such as for example, in beauty salons or specialized centres. In any case, what varies is the size of the tuning fork, whereas the pyramid remains approximately the same size. The device may be smaller in size in order to be applied individually for home use.

The size of the standard tuning fork in this invention is from 10 cm to 20 cm long and from 1 cm to 2 cm wide.

The larger device may be employed professionally in beauty salons having a size varying between 20 cm and 30 cm long and from 2.5 cm to 4.5 cm wide. In this case, it has two cylinders on the ends of the tines which amplify and optimize the effect of the device. The cylinders have a diameter of from 1.5 cm to 2.5 cm.

The pyramids have a square base varying between 0.6 cm and 1 cm on the side and a height of from 0.5 cm to 0.9 cm therefore they are small in comparison to the tuning fork.

The tuning forks in the invention are solid and have a hole drilled in the free end of the base (B) for receiving the vertex of the pyramid. When the pyramid has been inserted in the base of the turning fork it is subjected to soldering, preferably cold-soldering which permits both parts of the device which are the object of the invention to be joined in a permanent manner.

DESCRIPTION OF EMBODIMENTS OF THE INVENTION

In order to understand how the parts are arranged in the device and the size relating to each part a series of drawings are attached hereto as:

FIG. 1 which shows a standard tuning fork (1) such as those sold in the market with a base (B) and two tines (R) in a U-shape.

FIG. 2 shows two parts which make up the device, the tuning fork (1) and the pyramid (2) which is small compared to the tuning fork (1).

FIG. 3 shows the device as it is formed when the vertex of the pyramid (2) has been soldered to the free end of the tuning fork (1) base.

Figure 1:
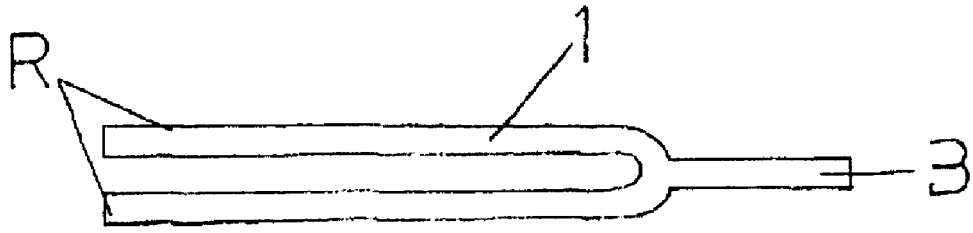
Figure 2:
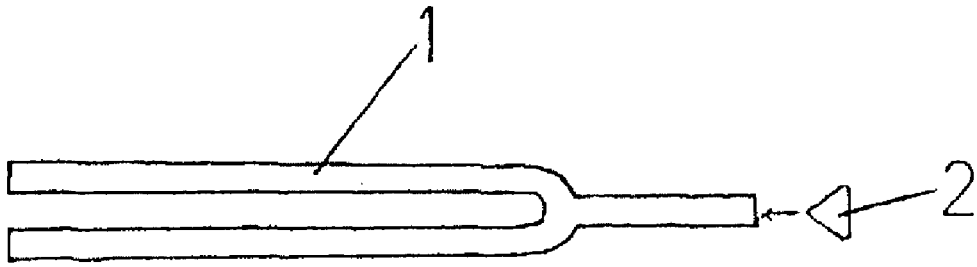
FIGS. 2 to 8 are embodiments of the invention.
Figure 3:
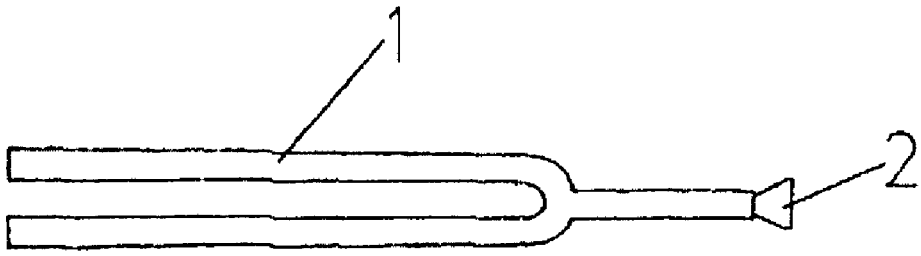
Figure 4:
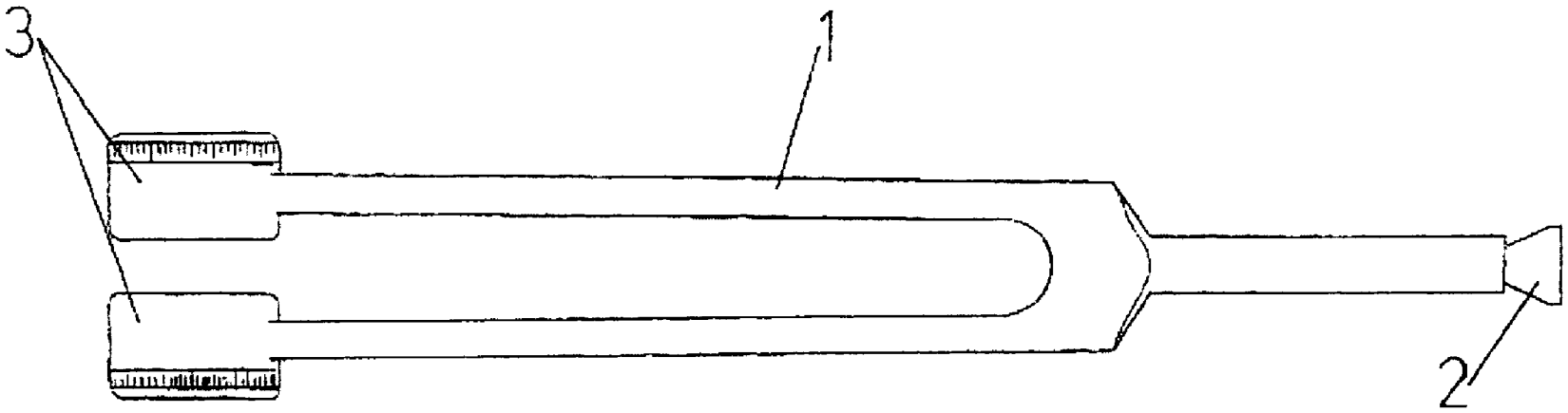

Some variants which are part of the inventive step of the application are also the object of this invention such as:

FIG. 4 which shows a professional device which is larger than the standard device and which has two cylinders (3) one at each end of the tines. In this case, the tuning fork is made from aluminium with alloys and may be provided with the means for graduating the position of the cylinders (3) with respect to the free end of the tuning fork tines.

Figure 5:
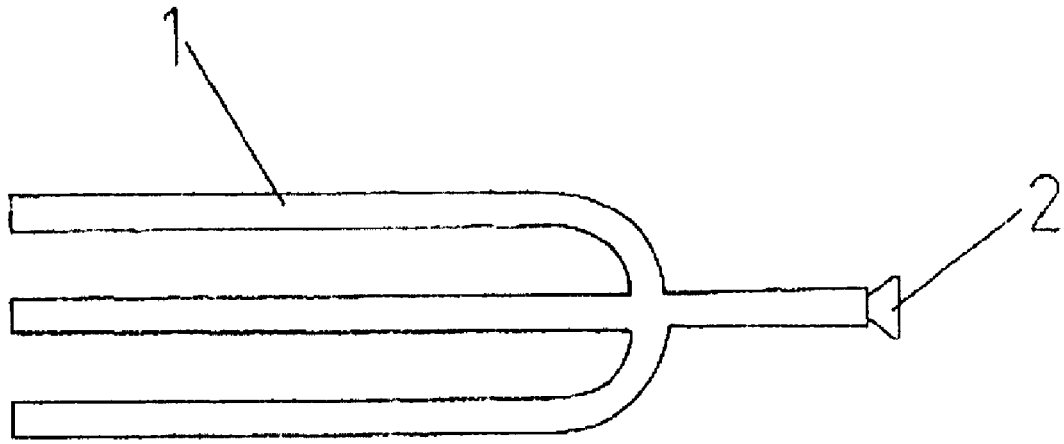

FIG. 5 is a variant of the tuning fork (1) with three tines and the pyramid (2) coupled to the perforated base of the tuning fork.

Figure 6:
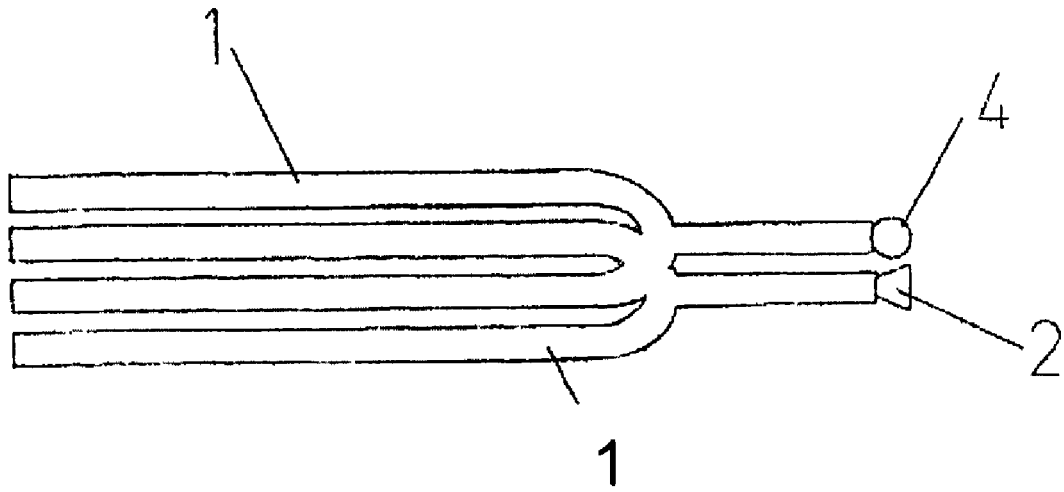

FIG. 6 is a variant consisting of two tuning forks (1) with two metal cast tines. The manufacture of this variant is achieved by means of two tuning forks each with two tines which are soldered approximately at the point where the base and the tines of each tuning fork join, so that the resulting device has four tines and two bases. At the free end of one of the bases it is soldered to the vertex of a pyramid (2) and the other base has a ball (4) on its free end.

The ball (4) in FIG. 6 is small and is made of metal which may be gold, silver or steel, and in winter it is appropriate to apply the ball made from gold which may be warmer than the other types of metal. Furthermore, the ball may be faceted to facilitate peeling of the skin.

Figure 7:
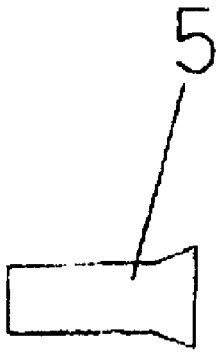

In addition, as an alternative in all these variants the two parts may be joined through an intermediate part, as shown in FIG. 7.

FIG. 7 shows a hollow intermediate part (5) with a cylindrical form at one end and a pyramidal trunk at the other for coupling to the tuning fork by it cylindrical end and with the pyramid by the pyramidal trunk end.

Figure 8:
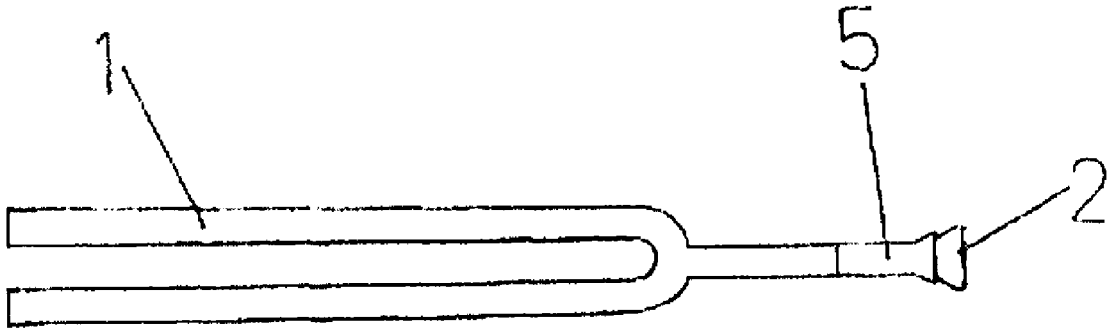

FIG. 8 shows this alternative of the device with the tuning fork (1), intermediate part (5) and pyramid (2) as they are positioned following soldering.

METHOD FOR APPLICATION OF THE DEVICE FOR PREVENTING SKIN SAG AND WRINKLES

For a treatment designed to prevent skin sag, and to smooth out wrinkles, rejuvenating the skin providing it with a luminous effect, the device is applied in various zones beginning with the area between the eyebrows and continuing to the areas around the lips.

After causing the tuning fork to vibrate, the pyramid base is placed between the eyebrows and moved over the skin travelling round the contours of one eye until the sound is extinguished. It is passed two or three times and each time in increasingly widening circular movements until it reaches the edge of the lower jaw. Subsequently it travels down from between the eyebrows to the area around the other eye.

Following these movements, the device is placed in the centre of the upper lip moving to the right border of the lip and subsequently from the centre to the left border of the lip. Finally, it is passed over the forehead from left to right.

Furthermore it may be applied to acupuncture points, in which case the method consists of applying the device on ten points for approximately 1 second each.

For mature skins it is appropriate for the base of the tuning fork to be gold plated and shaped like a mushroom thus enhancing the skin's luminous effect.

Comparative Example

Two tuning forks were used, one according to the larger version of the invention, for professional use in beauty salons and the other made from the same material and the same size in the tuning fork part with the exception that the pyramid was replaced by a ball of similar size joined by cold-soldering.

Both tuning forks were used for 4 weeks twice a week on a group of 4 patients. Two of the patients first received an application of the tuning fork with the ball and then that of the invention and the other 2 patients, conversely, received firstly the invention and then that of the tuning fork and ball leaving in all cases 4 weeks between the different treatments.

At the end of the treatments all the female patients and the beauty specialist who had applied the treatment agreed that the results with the tuning fork in this invention were visibly superior.

The invention claimed is:

1. A device for preventing skin sag and wrinkles, comprising:

a first tuning fork including a base and tines; and a pyramid-shaped stone joined to the first tuning fork such that a vertex of the pyramid-shaped stone is inserted on a free end of the base of the first tuning fork.

2. The device for preventing skin sag and wrinkles according to claim 1, wherein the first tuning fork includes a cylinder on an end of each of the tines.

3. The device for preventing skin sag and wrinkles according to claim 1, wherein the first tuning fork includes three tines.

4. The device for preventing skin sag and wrinkles according to claim 1, wherein the first tuning fork includes four tines.

5. The device for preventing skin sag and wrinkles according to claim 1, further comprising:

a second tuning fork soldered to the first turning fork at a point of connection of the base with the tines, wherein each of the tuning forks includes two tines.

6. The device for preventing skin sag and wrinkles according to claim 5, wherein second tuning fork includes a base such that the device includes four tines and two bases, and the pyramid-shaped stone is inserted into one of the bases and a metal ball is inserted into the other base.

7. The device for preventing skin sag and wrinkles according to claim 1, further comprising:

a hollow intermediate part between the first tuning fork and the pyramid-shaped stone, the hollow intermediate part including a cylindrical end and a pyramidal trunk end, wherein the base of the first tuning fork is inserted in the cylindrical end and the vertex of the pyramid-shaped stone is coupled to the pyramidal trunk end.

8. The device for preventing skin sag and wrinkles according to claim 7, wherein the base of the first tuning fork is soldered to the cylindrical end and the vertex of the pyramid-shaped stone is soldered to the pyramidal trunk end so that they are permanently joined.

9. The device for preventing skin sag and wrinkles according to claim 1 wherein the pyramid-shaped stone includes a precious or semi-precious stone.

10. The device for preventing skin sag and wrinkles according to claim 1, wherein the pyramid-shaped stone includes black tourmaline or onyx.

11. The device for preventing skin sag and wrinkles according to claim 1, wherein the pyramid-shaped stone is permanently joined to the first tuning fork via soldering.

12. The device for preventing skin sag and wrinkles according to claim 11, wherein the soldering is a cold soldering.

13. A method of preventing skin sag and wrinkles with a device including a tuning fork including a base and tines and a pyramid-shaped stone joined to the tuning fork such that a vertex of the pyramid-shaped stone is inserted on a free end of the base of the tuning fork, the method comprising:

vibrating the tuning fork; and placing the base of the pyramid-shaped stone on skin to be treated for the skin sag or wrinkles so that the pyramid-shaped stone transmits vibrations from the tuning fork to the skin.

* * * * *